United States Patent [19]

Inoue et al.

[11] Patent Number: 4,930,875

[45] Date of Patent: Jun. 5, 1990

[54] SCANNING DRIVER CIRCUIT FOR FERROELECTRIC LIQUID CRYSTAL DEVICE

[75] Inventors: Hiroshi Inoue, Yokohama; Yoshiyuki Osada, Atsugi; Yutaka Inaba, Kawaguchi, all of Japan

[73] Assignee: Canon Kabushiki Kaisha, Tokyo, Japan

[21] Appl. No.: 372,169

[22] Filed: Jun. 27, 1989

Related U.S. Application Data

[63] Continuation of Ser. No. 15,674, Feb. 17, 1987, abandoned.

[30] Foreign Application Priority Data

Feb. 17, 1986 [JP] Japan ..... 61-032480
Feb. 18, 1986 [JP] Japan ..... 61-034729

[51] Int. Cl.[5] ..... G02F 1/13; G09G 3/36

[52] U.S. Cl. ..... 350/333; 350/350 S; 340/805

[58] Field of Search ..... 350/332, 333, 350 S; 340/718, 719, 805, 811, 784; 357/23.7; 377/54

[56] References Cited

U.S. PATENT DOCUMENTS 4,380,008 4/1983 Kawakami et al. ..... 340/805
4,508,429 4/1985 Nagae et al. ..... 350/332
4,542,301 9/1985 Narabu ..... 307/269
4,682,858 7/1987 Kanbe et al. ..... 350/350 S
4,701,026 10/1987 Yazaki et al. ..... 350/350 S
4,711,531 12/1987 Masubuchi ..... 350/350 S
4,714,921 12/1987 Kanno et al. ..... 340/784
4,715,688 12/1987 Harada et al. ..... 350/350 S
4,746,196 5/1988 Umeda et al. ..... 350/350 S

FOREIGN PATENT DOCUMENTS 2067812 7/1981 United Kingdom ..... 350/333
2141279 12/1984 United Kingdom ..... 350/333

OTHER PUBLICATIONS

A. I. Lakatos—"Promise and Challenge of TFSi Approaches to Active Matrix", pp. 185-192—Proceedings of the SID—vol. 24/2, 1983.

D. J. Barclay—"Direct View Matrix-Addressable Displays Employing IC Drivers", pp. 2688-2690—IBM Technical Disclosure Bulletin—vol. 27, No. 4B—1984.

*Primary Examiner*—Andrew J. James
*Assistant Examiner*—Tai V. Duong
*Attorney, Agent, or Firm*—Fitzpatrick, Cella, Harper & Scinto

[57] ABSTRACT

A driving apparatus includes a scanning driver circuit connected to scanning electrodes and a signal driver circuit connected to signal electrodes. The scanning driver circuit includes: (1) a drive signal voltage generating unit which includes a first signal voltage generating unit for generating a scanning selection signal voltage supplied to a first bus, and a second signal voltage generating unit for generating a scanning nonselection signal voltage supplied to a second bus, (2) a switching circuit unit for selectively supplying the scanning selection signal or the scanning nonselection signal to a scanning electrode, and (3) a switching signal generating unit for supplying a switching control signal to the switching circuit unit.

24 Claims, 13 Drawing Sheets

SCANNING DRIVER CIRCUIT FOR FERROELECTRIC LIQUID CRYSTAL DEVICE

This application is a continuation of application Ser. No. 015,674 filed Feb. 17, 1987, now abandoned.

FIELD OF THE INVENTION AND RELATED ART

The present invention relates to a driving apparatus for an optical modulation device of the type wherein a contrast is discriminated depending on an applied electric field, particularly a ferroelectric liquid crystal device.

Flat panel display devices have been and are being actively developed all over the world. Among these, a display device using liquid crystal has been fully accepted in commercial use if the attention is restricted to a small scale one. However, it has been very difficult to develop a display device which has such a high resolution and a large picture area that it can substitute for a CRT (cathode ray tube) by means of a conventional liquid crystal system, e.g., those using a TN (twisted nematic) or DS (dynamic scattering) mode.

In order to overcome the drawbacks with such prior art liquid crystal devices, the use of a liquid crystal device having bistability has been proposed by Clark and Lagerwall (e.g., Japanese Laid-Open Patent Application No. 56-107216, U.S. Pat. No. 4367924, etc.). In this instance, as the liquid crystals having bistability, ferroelectric liquid crystals having chiral smectic C-phase (SmC*) or H-phase (SmH*) are generally used. These liquid crystals have bistable states of first and second stable states with respect to an electric field applied thereto. Accordingly, as different from optical modulation devices in which the above-mentioned TN-type liquid crystals are used, the bistable liquid crystal molecules are oriented to first and second optically stable states with respect to one and the other electric field vectors, respectively. The characteristics of the liquid crystals of this type are such that they are oriented to either of two stable states at an extremely high speed and the states are maintained when an electric field is not supplied thereto. By utilizing such properties, these liquid crystals having chiral smectic phase can essentially solve a large number of problems involved in the prior art devices as described above.

In a ferroelectric liquid crystal device, at least two writing or signal application phases are required in order to write in one line of pixels as disclosed in British Patent Specification GB-A2141279. More specifically, in a writing period for writing in one line of pixels comprising a ferroelectric liquid crystal, there are required a "white"-writing phase for providing a display state (assumed to be a "white" display state, for example) based on the first stable state of the ferroelectric liquid crystal and a "black"-writing phase for providing a display state (assumed to be a "black" display state) based on the second stable state. Moreover, it is necessary that a voltage signal for orienting the ferroelectric liquid crystal to the first stable state and a voltage signal for orienting the liquid crystal to the second stable state as described above, have mutually opposite polarities.

As a result, in order to write "white" or "black" selectively in one line of pixels, two scanning signal application phases are required corresponding to the two writing phases, and also the two scanning signals are of mutually opposite polarities (with respect to a reference potential).

In the driving of a conventional TN-type liquid crystal device, one line of pixels are written in one writing phase and moreover a TN-liquid crystal is driven by an AC r.m.s. voltage, so that the driving may be effected by a relatively simple circuit.

In contrast thereto, in the driving of a ferroelectric liquid crystal device, at least two writing phases are required for writing in one line of pixels and the "white" writing signal and "black" writing signal are required to be of mutually opposite polarities, so described above, so that a complicated circuit structure has been required compared with a driver circuit for a conventional TN-liquid crystal device. Therefore, the driver circuit for a ferroelectric liquid crystal requires a large number of driver ICs (integrated circuits) and also a large number of connecting points between the ICs and the ferroelectric liquid crystal device. As a result, a driving circuit for a ferroelectric liquid crystal device is liable to be expensive.

SUMMARY OF THE INVENTION

An object of the present invention is to provide a driving apparatus which solves the above mentioned problems, particularly a driving apparatus with a simple circuit structure adapted for a ferroelectric liquid crystal device.

According to the present invention, there is provided a driving apparatus which comprises a scanning driver circuit connected to scanning electrodes and a signal driver circuit connected to signal electrodes; the signal driver circuit comprising:

(1) a drive signal voltage generating unit which includes a first signal voltage generating unit for generating a scanning selection signal voltage supplied to a first bus, and a second signal voltage generating unit for generating a scanning nonselection signal voltage supplied to a second bus, (2) a switching circuit unit for selectively supplying the scanning selection signal or the scanning nonselection signal to a scanning electrode; and (3) a switching signal generating unit for supplying a switching control signal to the switching circuit unit.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

An optical modulation material used in an optical modulation device to which the present invention may be suitably applied, may be a material capable of providing a discriminatable contrast by assuming at least a first optically stable state (assumed to provide, e.g., a "bright" state) and a second optically stable state (assumed to provide, e.g., a "dark" state) depending on an electric field applied thereto, the preferably a material showing bistability in response to an applied electric field, and particularly a liquid crystal showing such properties.

Preferable liquid crystals having bistability which can be used in the driving method according to the present invention are smectic, particularly chiral smectic, liquid crystals having ferroelectricity. Among them, chiral smectic C phase (SmC*)-, or H (SmH*)-, I (SmI*)-, F (SmF*)- or G (SmC*)-phase liquid crystals are suitable therefor. These ferroelectric liquid crystals are described in, e.g., "LE JOURNAL DE PHYSIQUE LETTERS", 36 (L-69), 1975, "ferroelectric Liquid Crystals"; "Applied Physics Letters" 36 (11), 1980, "Submicro Second Bistable Electrooptic Switching in Liquid Crystals", "Kotai Butsuri (Solid State Physics)" 16 (141), 1981, "Liquid Crystal", etc. Ferroelectric liquid crystals disclosed in these publications may be used in the present invention.

More particularly, examples of ferroelectric liquid crystal compounds used in the method according to the present invention are decyloxybenzylidene-p'-amino-2-methylbutyl-cinnamate (DOBAMBC), hexyloxybenzylidene-p'-amino-2-chloropropylcinnamate (HOBACPC), 4-o-(2-methyl)-butylresorcylidene-4'-octylaniline (MBRA8), etc.

When a device is constituted by using these materials, the device may be supported with a block of copper, etc., in which a heater is embedded in order to produce a temperature condition where the liquid crystal compounds assume an SmC*-, SmH*-, SmI*-, SmF*- or SmG*-phase.

Figure 13:
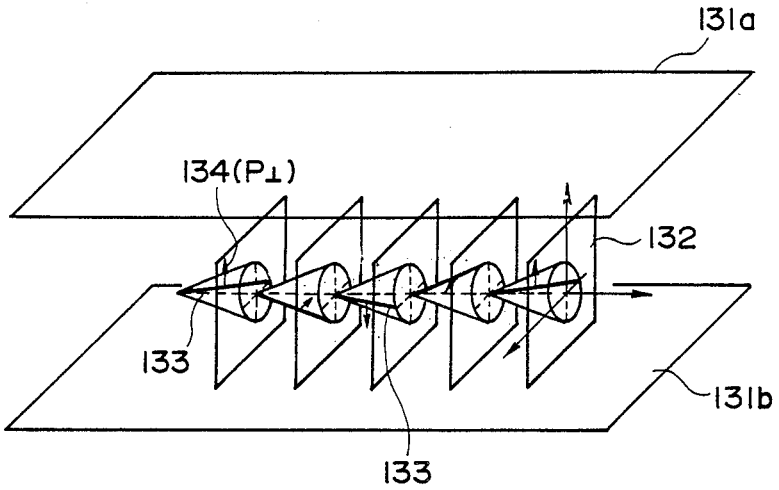
FIGS. 13 and 14 are schematic perspective views illustrating a ferroelectric liquid crystal device used in the present invention.
Figure 14:
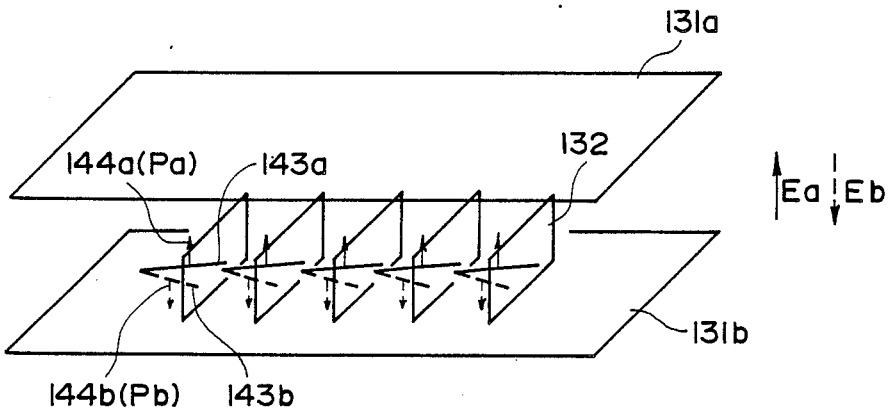

Referring to FIG. 13, there is schematically shown an example, of a ferroelectric liquid crystal cell. Reference numerals 131*a* and 131*b* denote substrates (glass plates) on which a transparent electrode of, e.g., $In_2O_3$, $SnO_2$, ITO (Indium Tin Oxide), etc., is disposed, respectively. A liquid crystal of an SmC*-phase in which liquid crystal molecular layers 132 are oriented perpendicular to surfaces of the glass plates is hermetically disposed therebetween. A full line 133 shows liquid crystal molecules. Each liquid crystal molecule 133 has a diple moment (P⊥) 132 in a direction perpendicular to the axis thereof. When a voltage higher than a certain threshold level is applied between electrodes formed on the substrates 131*a* and 131*b*, the helical structure of the liquid crystal molecule 133 is unwound or released to change the alignment direction of respective liquid crystal molecules 133 so that the dipole moments (P⊥) 134 are all directed in the direction o the electric field. The liquid crystal molecules 133 have an elongated shape and show refractive anisotropy between the long axis and the short axis thereof. Accordingly, it is easily understood that when, for instance, polarizers arranged in a cross nicol relationship, i.e., with their polarizing directions crossing each other are disposed on the upper and the lower surfaces of the glass plates, the liquid crystal cell thus arranged functions as a liquid crystal optical modulation device whose optical characteristics vary depending upon the polarity of an applied voltage. Further, when the thickness of the liquid crystal cell is sufficiently thin (e.g., 1 micron), the helical structure of the liquid crystal molecules is unwound without application of an electric field whereby the dipole moment assumes either of the two states, i.e., Pa in an upper direction 144*a* or Pb in a lower direction 144*b* as shown in FIG. 14. When electric field Ea or Eb, higher than a certain threshold level and different from each other in polarity as shown in FIG. 14, is applied to a cell having the above-mentioned characteristics, the dipole moment is directed either in the upper direction 144*a* or in the lower direction 144*b* depending on the vector of the electric field Ea or Eb. In correspondence with this, the liquid crystal molecules are oriented in a first stable state 143*a* (bright state) or a second stable state 143*b* (dark state).

When the above-mentioned ferroelectric liquid crystal is used as an optical modulation element, it is possible to obtain two advantages. First, the response speed is quite fast. Second, the orientation of the liquid crystal exhibits bistability. The second advantage will be further explained, e.g., with reference to FIG. 14. When the electric field Ea is applied to the liquid crystal molecules, they are oriented to the first stable state 143*a*. This state is stably retained even if the electric field is removed. On the other hand, when the electric field Eb whose direction is opposite to that of the electric field Ea is applied thereto, the liquid crystal molecules are oriented to the second stable state 143*b*, whereby the directions of the molecules are changed. Likewise, the latter state is stably retained even if the electric field is removed. Further, as long as the magnitude of the electric field Ea or Eb being applied is not above a certain threshold value, the liquid crystal molecules are placed in their respective orientation states. In order to effectively realize high response speed and bistability, it is preferable that the thickness of the cell is as thin as possible and generally 0.5 to 20 microns, particularly 1 to 5 microns. A liquid crystal-electrooptical device having a matrix electrode structure using a ferroelectric liquid crystal of the type as described above has been proposed, e.g., by Clark and Lagerwall in U.S. Pat. No. 4,367,924.

Figure 1:
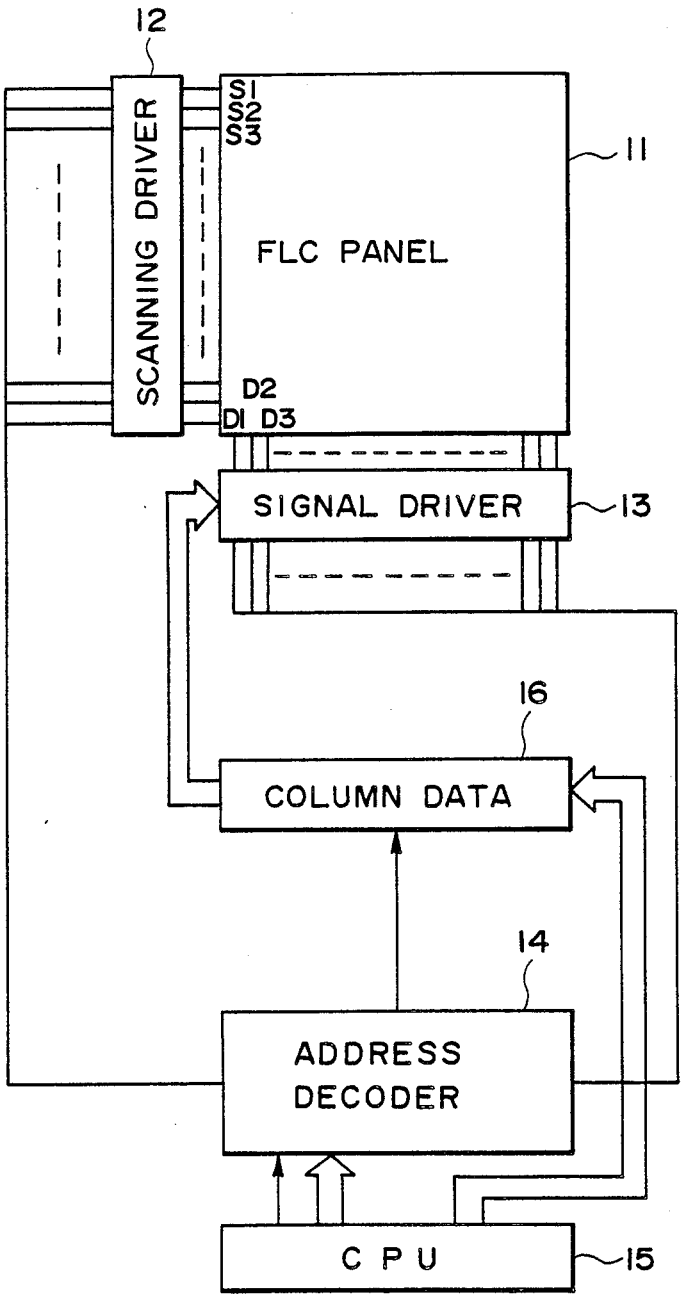
FIG. 1 is a block diagram of a driving apparatus according to the present invention.
Figure 3:
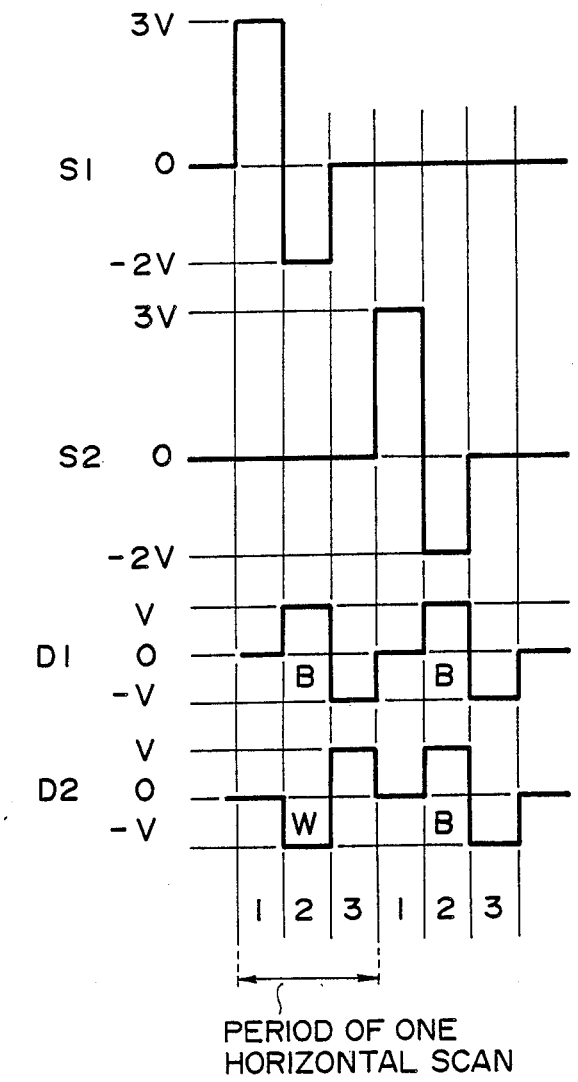
FIG. 3 illustrates driving waveforms used in the present invention.

FIG. 1 is a block diagram of a driving apparatus for a ferroelectric liquid crystal device (hereinafter, the term "ferroelectric liquid crystal" is sometimes abbreviated as "FLC"). More specifically, a driving unit for an FLC panel 11 comprises a scanning driver circuit 12 and a signal driver circuit 13. The scanning driver circuit 12 supplies scanning signals $S_1$, $S_2$, ..., and the signal driver circuit 13 supplies data signals $D_1$, $D_2$, ..., respectively as shown in FIG. 3. The addresses of the scanning driver circuit 12 and the signal driver circuit 13 are respectively determined by an address decoder 14. Further, column data 16 are governed by a CPU 15 and supplied to the signal driver circuit 13.

Figure 2:
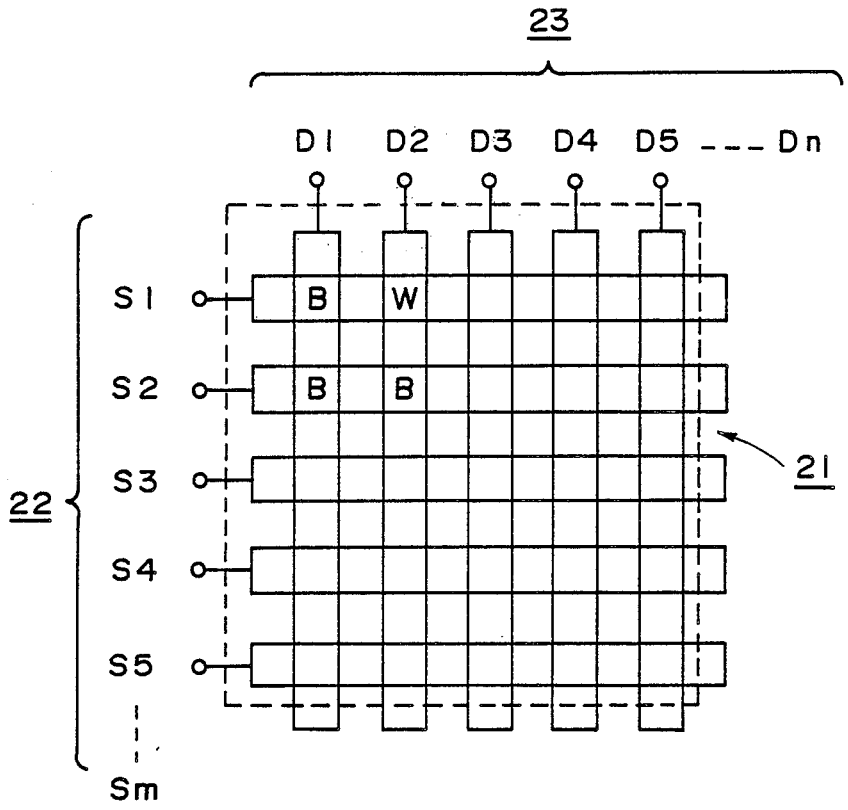
FIG. 2 is a plan view showing a matrix electrode arrangement used in the present invention.

FIG. 2 is a schematic plan view of a panel 21 having a matrix electrode comprising a number (m) of scanning electrodes 22 ($S_1$, ... Sm) and a number (n) of signal electrodes 33 ($D_1$, ... Dn) with a ferroelectric liquid crystal (not shown) as an optical modulation material sandwiched therebetween. The scanning electrodes 22 are sequentially selected in the order of $S_1$, $S_2$, $S_3$, ..., Sm. Further, when a scanning electrode is selected, the signal electrodes 23 ($D_1$, .., Dn) are respectively supplied with signals corresponding to image data. FIG. 3 shows an example of set a signals applied to electrodes $S_1$, $S_2$, $D_1$ and $D_2$ for providing a display state as shown in FIG. 2. When a pixel at an $S_1$–$D_1$ is displayed in "black" (denoted by "B" in the figure) based on the second stable state of the ferroelectric liquid crystal, a pixel at an $S_1$–$D_2$ intersection is displayed in "white" (denoted by "W" in the figure) based on the first stable state of the ferroelectric liquid crystal, and pixels at the $S_2$–$D_1$ and $S_2$–$D_2$ intersections are both displayed in "black". As is clear from FIG. 3, in a period comprising phases 1-2-3, a black signal B and a white signal W are selectively applied to pixels on a selected scanning line $S_1$ at phase 2 to write in the pixels on the scanning line $S_1$. At phase 1, a voltage of 3V exceeding the first threshold voltage $V_{th1}$ is applied to all the pixels on the scanning line $S_1$, whereby all the pixels are written in "white" based on the first stable state of the FLC. At phase 2, a pixel supplied with a black signal B is supplied with a voltage of −3V exceeding the second threshold voltage $V_{th2}$ to be inverted into "black" based on the second stable state of the FLC, while a pixel supplied with a white signal W is supplied with a voltage of −V not exceeding the second threshold voltage $V_{th2}$ to retain the "white" display state resultant in the phase 1 as it is. Further, the signals of ±V applied at phase 3 are signals not changing the display states of the pixels written at the phase 2 and are used to prevent a cross-talk phenomenon which is caused by a data signal continuously applied to one pixel, e.g., in a case where a white signal W is continuously applied to one pixel through a signal electrode. In this instance, the signal applied at phase 3 is preferably one of a polarity opposite to that of the signal applied to the signal applied at phase 2 with respect to a reference potential.

As a result, the written states of one line of pixels are determined at the above mentioned phase 2, and by sequentially repeating the operation of phases 1-2-3 including the phase 2 row by row, writing of one whole picture is effected. In this instance, the voltage value V is set to satisfy the following relations with the first threshold voltage $V_{th1}$ for providing the first stable state (white) of the FLC and the second threshold voltage $V_{th2}$ for providing the second stable state (black) of the FLC, i.e., $3V > V_{th1} > V$ and $-3V < V_{th2} < -V$.

As described above, in the FLC panel, the "white" signal W (−V) and the "black" signal B (+V) with polarities different from each other are selectively applied to the signal electrodes 23 in a single scanning signal phase, i.e., phase 2.

Figure 4:
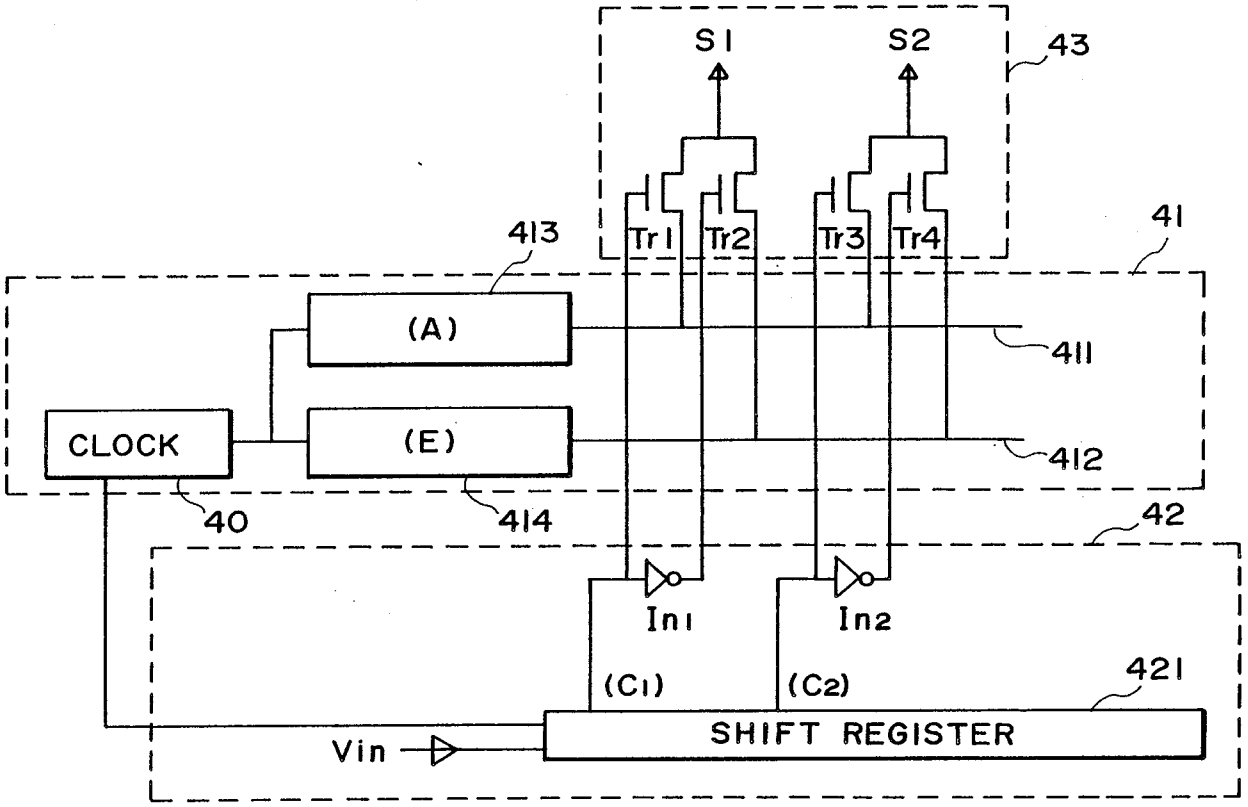
FIG. 4 is a block diagram of a scanning driver apparatus of the present invention.

FIG. 4 is a block diagram of a driving apparatus for generating the above mentioned scanning signals $S_1$, $S_2$, ... The driving apparatus is provided with a drive signal generating unit 41 for generating a scanning selection signal voltage (A) and a scanning nonselection signal voltage (E), a switching signal generating unit 42 for generating a switching control (timing) signal, and a switching circuit 43 for periodically and sequentially supplying a scanning selection signal to the scanning electrodes.

Figure 5:
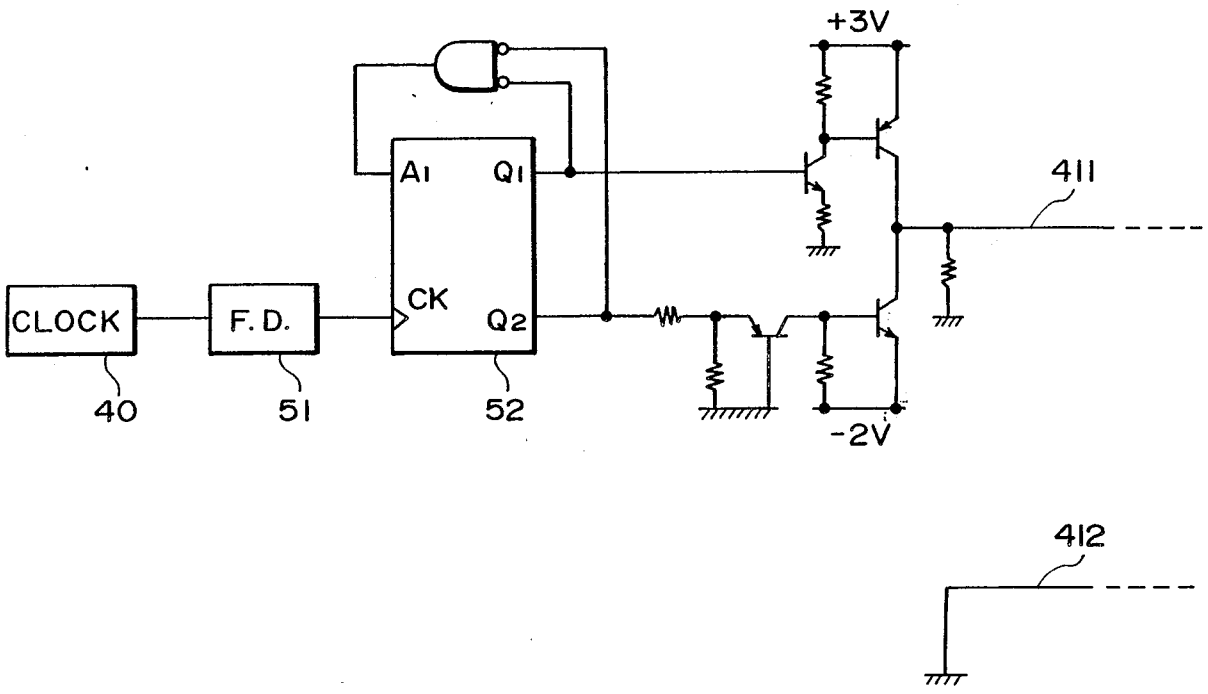
FIG. 5 illustrates a drive waveform generating circuit.
Figure 6:
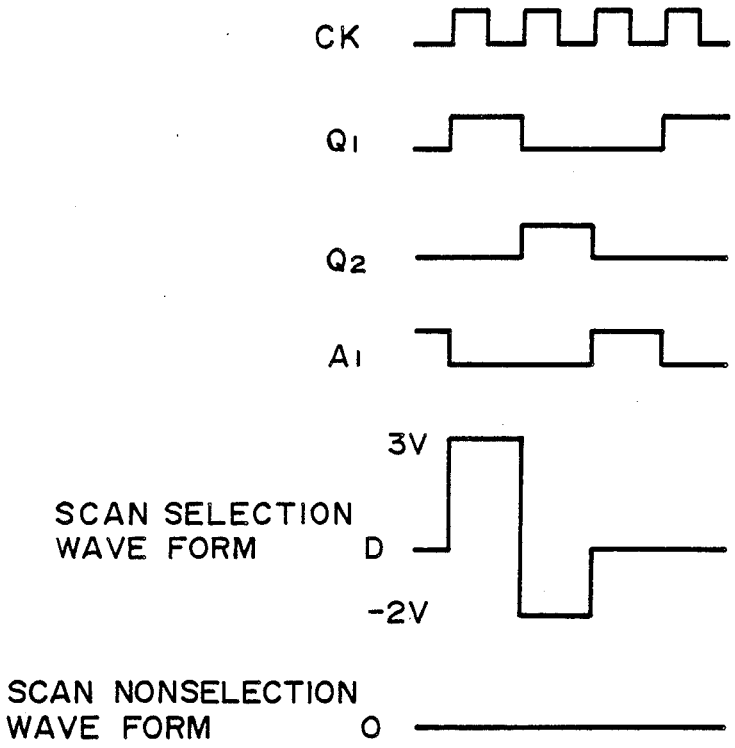
FIG. 6 is a time chart therefor.
Figure 7:
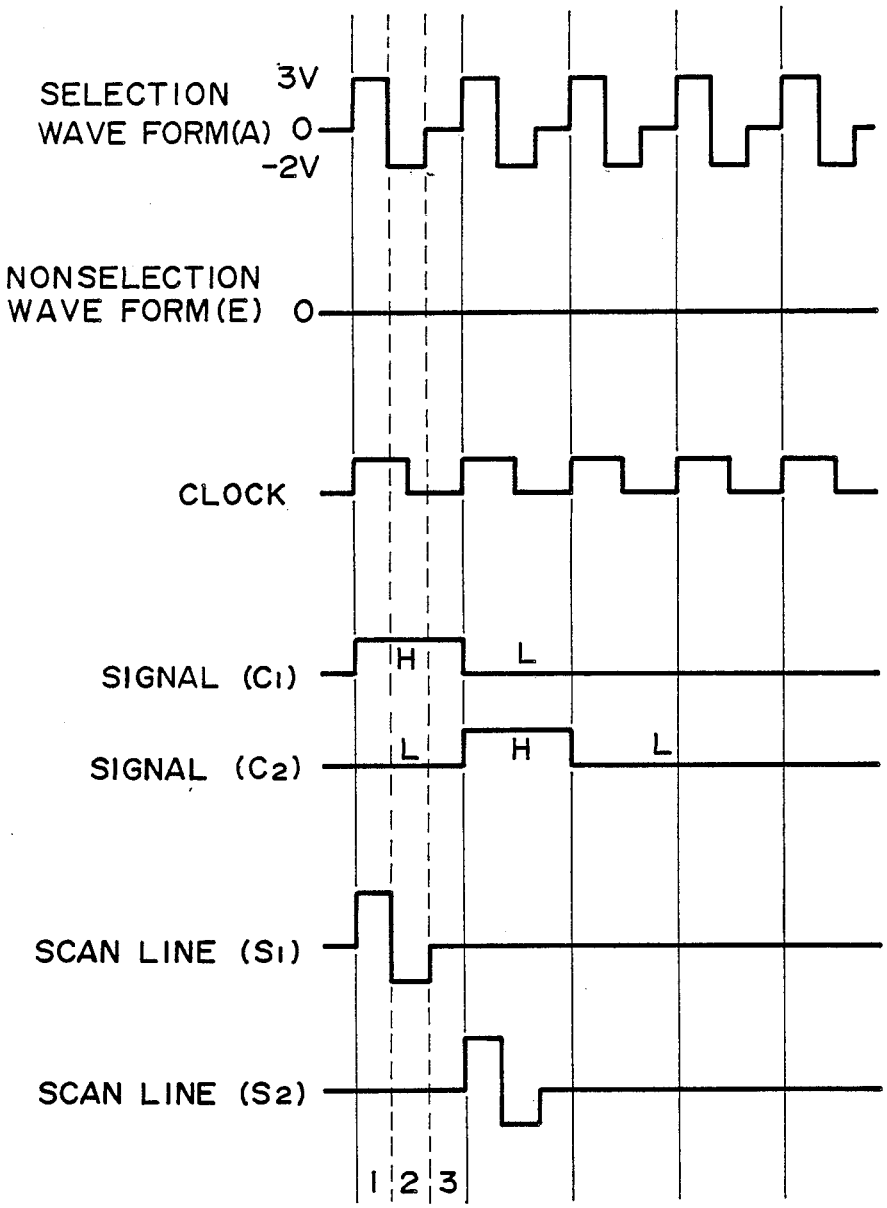
FIG. 7 is a time chart for a driving apparatus according to the present invention.

The drive signal generating unit 41 includes a scanning selection signal generating circuit 413 for generating a scanning selection signal voltage (A) as shown at (A) in FIG. 7 and a scanning nonselection signal generating circuit 414 for generating a scanning nonselection signal voltage (E) as shown at (E) in FIG. 7, which are connected to a scanning selection signal bus 411 and a scanning nonselection signal bus 412, respectively. The two buses 411 and 412 are respectively connected to the switching circuit unit 43. FIG. 5 shows more detailed circuit arrangements of the scanning selection signal generating circuit 413 and the scanning nonselection signal generating circuit 414. Basic clock signals from a clock 40 are supplied to a shift register 52 through a frequency demultiplier 51. FIG. 6 shows a time chart for the circuit.

Figure 8:
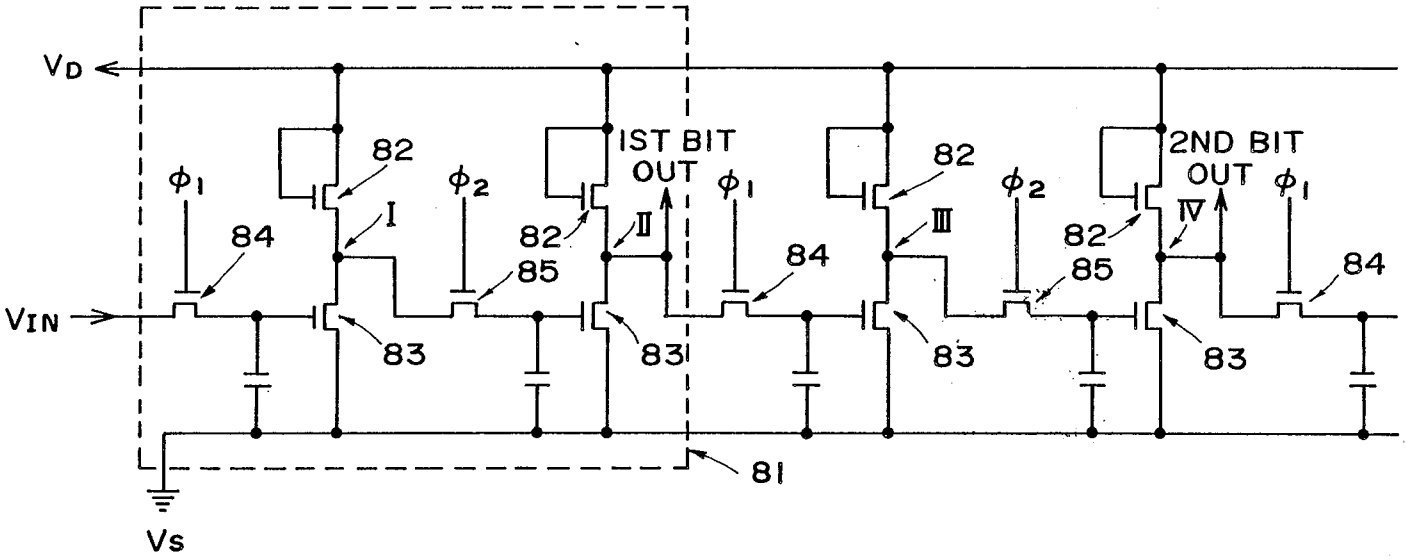
FIG. 8 illustrates a dynamic shift register used in the present invention.

The switching signal generating unit 42 includes a shift register 421 and inverters $In_1$, $In_2$, ... connected to the shift register. A preferred embodiment of the shift register 421 is shown in FIG. 8. The shift register shown in FIG. 8 is a dynamic shift register incorporating inverters. A timing signal Vin is supplied as an input signal.

Figure 9:
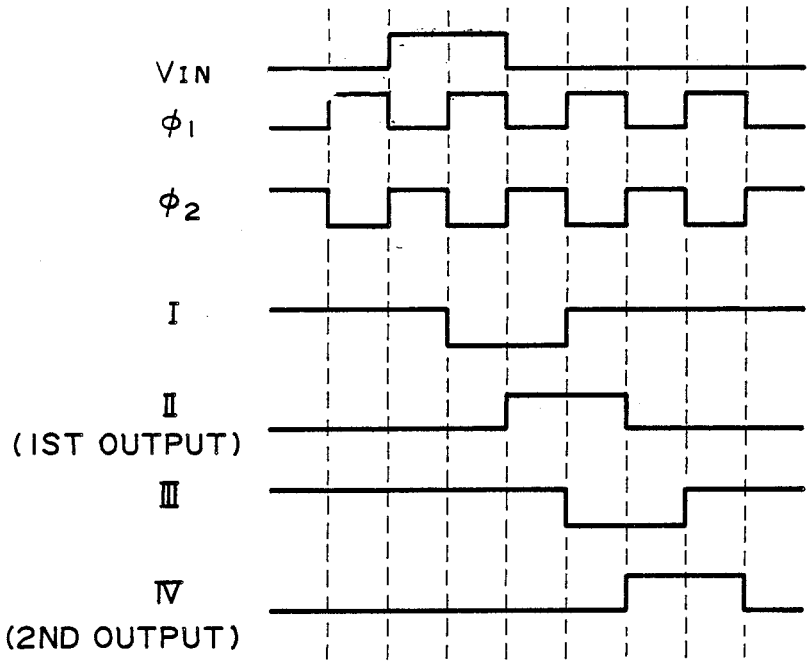
FIG. 9 is a time chart therefor.

FIG. 9 shows a time chart for the input signal Vin, a clock signal $\phi_1$, a clock signal $\phi_2$, a signal at point I, a signal at point II (first stage output, corresponding to one denoted by "1st bit out"), a signal at point III, and a signal at point IV corresponding to the input signal Vin. FIG. 9 shows that the input pulse is shifted to a subsequent stage for each cycle of the clock signal $\phi$. The clock signal $\phi_1$ corresponds to one supplied from the clock 40 in FIG. 4, and the clock signal $\phi_2$ is one obtained by inverting it. In the present invention, the operating frequency of the shift register 421 is definitely determined by the scanning frequency (frame frequency) of the panel 21 and the number of pixels, so that a dynamic shift register having less elements (and adapted for a high speed operation is preferably used) than a static shift register having many elements.

In FIG. 8, a block surrounded by the dotted line denotes a first block 81 of the shift register, $V_D$ denotes a supply voltage, and $V_S$ denotes 0 volt (ground). A load transistor 82 and drive transistors 83, 84 and 85 in each block may comprise a thin film semiconductor such as amorphous silicon, polysilicon, CdSe, or ZnSe as a semiconductor.

Figure 10A:
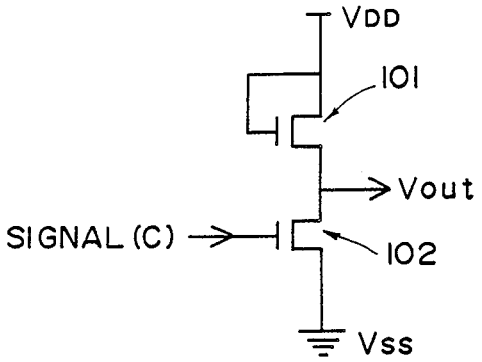
FIG. 10A is an equivalent circuit diagram of an inverter.
Figure 10B:
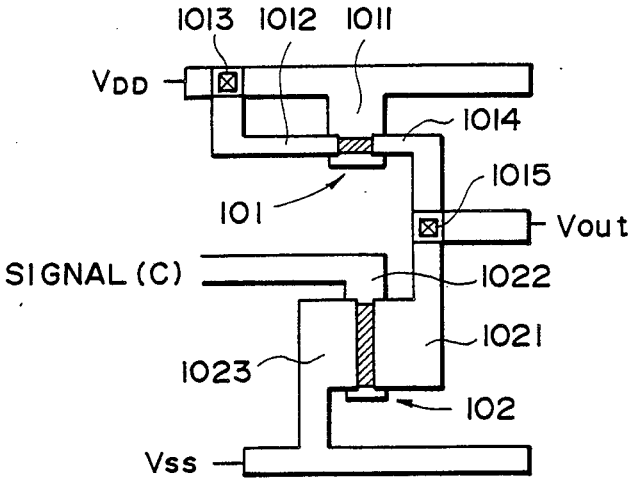
FIG. 10B is a plan view showing the layout thereof.
Figure 10C:
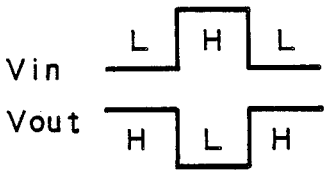
FIG. 10C illustrates input and output characteristics of the inverter.

FIG. 10A shows an equivalent circuit of a signal inverter 101 functioning as one of the inverters $In_1$, $In_2$, ... used in the switching control signal generating unit 42; FIG. 10B is a plan view showing the layout thereof; and FIG. 10C illustrates the relationships between the input and output of the circuit. In FIG. 10A, $V_{SS}$ denotes 0 volt (ground state), and $V_{DD}$ denotes a power supply voltage. In the inverter, an output signal (C) from the shift register 421 may be controlled by a load transistor 101 and a drive transistor 102 to provide a switching timing signal $V_{out}$. The load transistor 101 has a gate 1011 and a source 1012 which are short-circuited through a contact hole 1013, and also a drain 1014 which is connected with a source 1021 of the drive transistor 102 through a contact hole 1015.

The drive transistor 102 has a gate 1022 to which a signal (C) is supplied, and a drain 1023 connected to $V_{SS}$. The hatched portions in FIGS. 10B comprises thin film semiconductors such as amorphous silicon, polysilicon, CdSe or ZnSe.

When the signal (C) from the output stages (point II, point IV, ...) is "H" (high level; indicating "1"), transistors $Tr_1$, $Tr_3$, ..., $Tr_{2m-1}$ (m: number of scanning lines) in the switching circuit unit 43 are selected to supply a signal waveform (A) from a scanning selection signal bus 411 to the scanning electrodes. On the other hand, when the signal (C) from the output stages (point II, point IV, ...) is "L" (low level; indicating "0"), transistors $Tr_2$, $Tr_4$, ..., $Tr_{2m}$ are selected to supply a signal waveform (E) from a scanning nonselection bus 412 to the scanning electrodes. The above transistors $Tr_1$, $Tr_2$, ... may also comprise a thin film semiconductor of amorphous silicon, polysilicon, CdSe, ZnSe, etc. FIG. 7 shows time-serial waveforms applied at this time to the scanning lines $S_1$, $S_2$, ...

As understood from FIG. 7, when an output signal C ($C_1$, $C_2$, ...) is at the "H" level, a scanning selection signal with a signal waveform (A) having phases 1-2-3 is sequentially supplied to the scanning signal. On the other hand, to the scanning lines placed at the time of nonselection, a scanning nonselection signal with a signal waveform (E) having phases 1-2-3 is applied, as the output signals C ($C_1$, $C_2$, ...) are at the "L" level.

In this way, in the switching signal generating unit 42, a timing signal Vin is serially supplied to the shift register 421, which is controlled by the pulses from the clock 40; and is converted into timing pulses for one scanning line, and the timing pulses may be shifted for each scanning period (e.g., comprising the phase 1-2-3). As a result, as the above mentioned pulse at the "H" level is shifted sequentially with the lapse of time, the inverters $In_1$, $In_2$, ... operate to switch the transistors $Tr_1$, $Tr_2$, ... sequentially to the scanning selection signal bus 411, whereby a scanning selection signal is sequentially supplied to the scanning electrodes 22.

In the driving apparatus according to the present invention, the transistors $Tr_1$, $Tr_2$, ... used in the above mentioned switching circuit unit 43, the inverters $In_1$, $In_2$, ... used in the switching signal generating unit 42, and the transistors in the shift register 421 may be composed of MOS- or MOS-FET transistors, and these transistors may be formed as thin film transistors on one glass substrate by using a semiconductor material such as amorphous silicon, polysilicon, CdSe or ZnSe. As a result, according to the present invention, a display apparatus having fewer parts and fewer connections may be prepared by forming the switching circuit unit 43, the switching signal generating unit 42, the scanning selection signal bus 411 and the scanning nonselection bus 412 on a single glass substrate constituting an FLC panel 21 and combining them with the scanning selection signal generating circuit 413, the scanning nonselection signal generating circuit 414 and the clock 40 as external circuits.

Further, in the driving apparatus according to the present invention, it is possible to form the switching circuit 43 and the switching control signal generating unit 42 on a single glass substrate and to connect them with a ferroelectric liquid crystal device by wire bonding or by using an anisotropic conductive adhesive.

According to the present invention, there is provided a driving apparatus of a simple circuit structure for a scanning driver circuit for supplying a scanning signal having at least two signal phases and having mutually opposite polarities in the two phases with respect to a reference potential. As a result, the number of ICs used in the driving apparatus may be decreased and the production cost of a display apparatus may be minimized.

Figure 11:
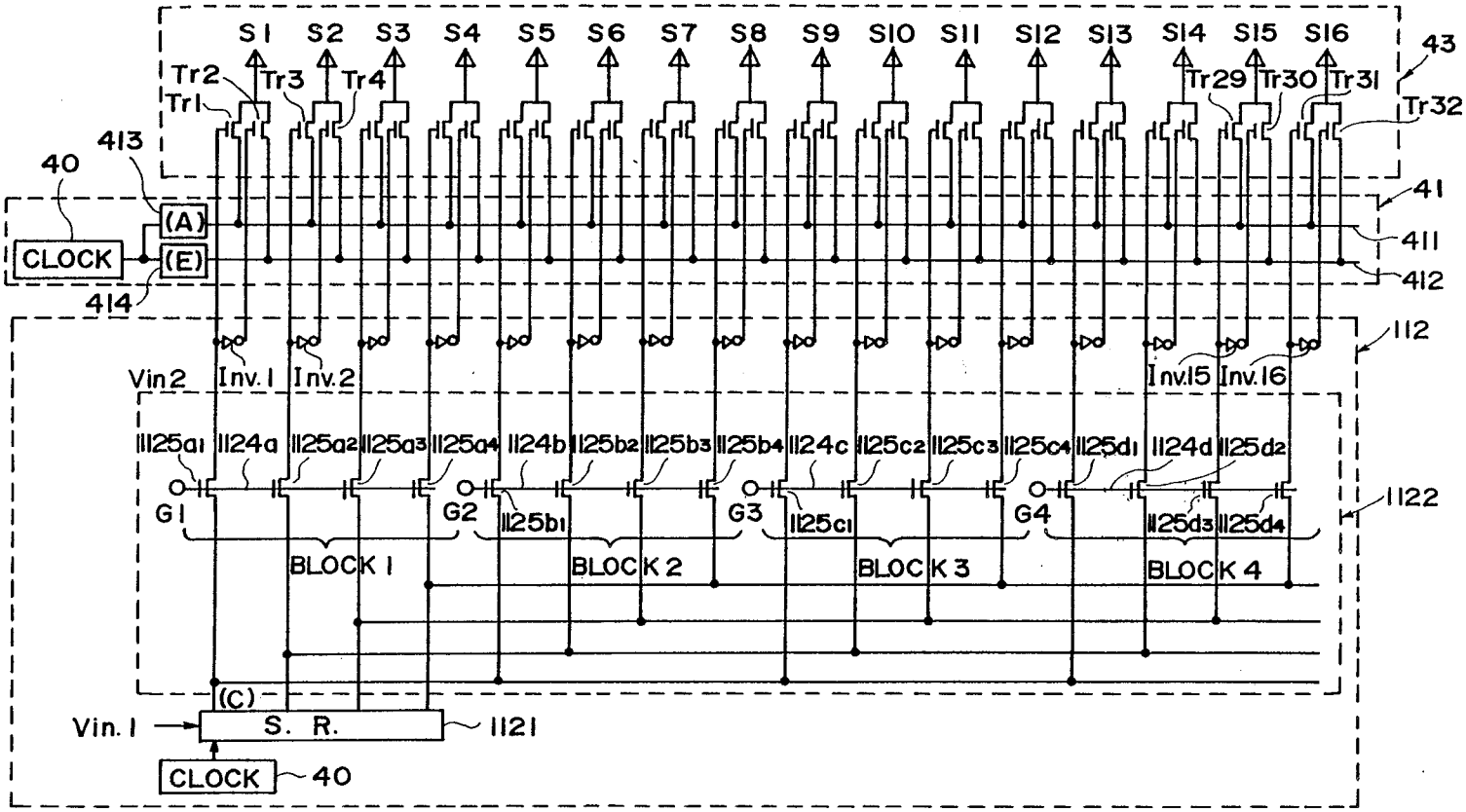
FIG. 11 is a block diagram illustrating another driving apparatus of the invention.

FIG. 11 shows another embodiment of the driving apparatus according to the present invention. The driving apparatus in FIG. 11 is particularly characterized by a signal generating circuit 112 for generating a switching control signal. The switching control signal generating circuit comprises (a) a serial-parallel converter circuit and (b) a matrix circuit comprising a plurality of switching elements divided into a plurality of blocks, the switching elements in each block being commonly connected to a control line, the output signals from the serial-parallel converter circuit being distributed to the respective blocks.

More specifically, FIG. 11 is a block diagram of a driving apparatus for generating the above mentioned scanning signals $S_1$, $S_2$, ... The driving apparatus comprises a drive signal waveform generating unit 41, substantially the same as the corresponding one in FIG. 4, for generating a selection signal voltage (A) and a scanning nonselection signal voltage (E); a switching control signal generating unit 112 for generating a timing signal for switching; and a switching circuit 43, substantially the same as the corresponding one in FIG. 4, for periodically and sequentially supplying a scanning selection signal waveform to the scanning electrodes.

The switching control signal generating unit 112 comprises a serial-parallel conversion circuit such as a shift register 1121 whereby input serial data $Vin_1$ are subjected to serial-parallel conversion; a matrix circuit 1122; and inverters Inv.1, Inv.2, ... having the function of generating a switching signal depending on a timing or switching control signal supplied from the matrix circuit 1122.

The shift register 1121 may be a dynamic shift register as explained with reference to FIG. 8. The clock 40 in FIG. 11 is substantially the same as the clock 40 in FIG. 4.

Figure 12:
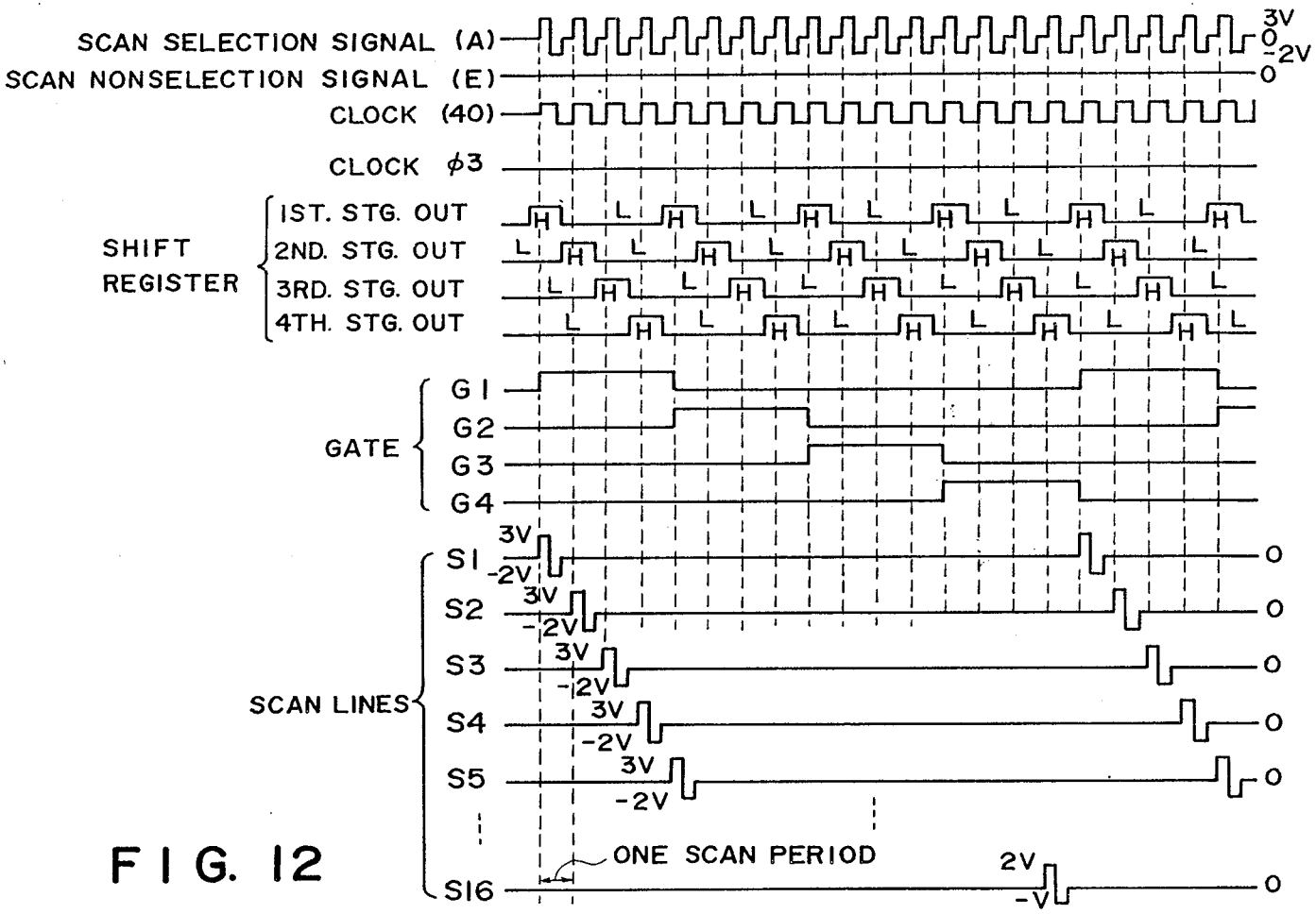
FIG. 12 is a time chart therefor.

The matrix circuit 1122 used in the present invention will now be explained with reference to FIG. 11 and FIG. 12 showing a timing chart therefor. For brevity of the explanation, an embodiment is explained wherein the number of total bits on the scanning side (the number of scanning lines) m is 16 including $S_1$, $S_2$, ...., $S_{16}$ and the number of divisions (number of blocks) is 4.

In the matrix circuit 1122, 16 bits are divided into 4 blocks (BLOCKs 1, 2, 3 and 4) each comprising 4 bits, and switching elements 1125 (1125a1–1125a4, 1125b1–1125b4, 1125c1–1125c4, and 1125d1–1125d4) are disposed corresponding to the respective bits so that they are connected in common for each block to one of control lines 1124 (**1124*a*, 1124*b*, 1124*c* and 1124*d***).

In the present invention, the above mentioned switching elements 1125 may be composed of MOS or MIS-field effect transistors, particularly thin film transistors, so that each of the control lines 1124 is commonly connected to the gates of related thin film transistors.

The sources of the switching transistor elements in each block are respectively connected to the output stages of the shift register 1121 so as to provide a matrix. For example, the first stage output line of the shift register 1121 is commonly connected to the transistor 1125a1 in Block 1, the transistor 1125b1 in Block 2, the transistor 1125c1 in Block 3 and the transistor 1125d1 in Block 4. In the same manner, the second, third and fourth output lines of the shift register 1121 are connected commonly to the transistors (1125a2, 1125b2, 1125c2 and 1125d2), (1125a3, 1125b3, 1125c3 and 1125d3) and (1125a4, 1125b4, 1125c4 and 1125d4), respectively, in the respective blocks. Further, as mentioned above, the gates of the transistors in each block are commonly connected to one of the control lines **1124*a*–1124*d*, to which gate-on pulses as shown at $G_1$, $G_2$, $G_3$ and $G_4$ in FIG. 12 are sequentially applied from the terminals $G_1$, $G_2$, $G_3$ and $G_4$, respectively. On the other hand, the drains of the switching transistors 1125 are respectively connected to the inverters. In this instance, the output time of a gate-on pulse is shifted by $\Delta T$ from the output time of the shift register 1121**. It is preferred to have the period $\Delta T$ be equal to the period of one scanning phase during one horizontal scanning period.

FIG. 12 is a timing chart for the respective signals, based on the clock signals 40, including the outputs of the shift register 1121, the outputs of the control lines (gate-on pulses $G_1$, $G_2$, $G_3$, $G_4$) and the outputs to the scanning lines $S_1$–$S_{16}$. In FIG. 12, "L" (low level) and "H" (high level) indicate the logical levels corresponding to "0" and "1" respectively.

As shown in FIG. 12, in the present invention, a scanning selection signal (A) is sequentially supplied to the scanning lines $S_1 \rightarrow S_2 \rightarrow S_3 \rightarrow \ldots \rightarrow S_{16}$ in a period of 1 frame. The outputs of the shift register 1121 may be distributed by a matrix circuit 1122 so that line-sequential selection as shown in FIG. 12 may be effected in one frame period. More specifically, during a period when a gate $G_1$ for a control line 1124 is turned on, the scanning lines $S_1$–$S_4$ are sequentially selected to supply a scanning selection signal. At this time, the gates $G_2$–$G_4$ are kept turned on. Then, the gates $G_2$–$G_4$ are sequentially turned on, and the scanning lines $S_5 \rightarrow S_6 \rightarrow \ldots \rightarrow S_{16}$ are sequentially selected to supply a scanning selection signal waveform (A). One cycle of the clock 40 corresponds to one horizontal scanning period.

In the apparatus shown in FIG. 11, it is also possible to form the switching circuit 43 and the switching control signal generating unit 112 on a single glass substrate and to connect them with a ferroelectric liquid crystal device by wire bonding or by using an anisotropic conductive adhesive.

In the above embodiment of the driving apparatus, an embodiment of the matrix circuit unit 1122 comprising 16 bits of scanning lines divided into 4 blocks is explained. However, the number of scanning lines and the number of blocks are not essentially restricted.

According to the present invention, the total number of switching transistors used in the scanning driver circuit can be decreased. More specifically, as shown in FIG. 11, the switching circuit unit 43 includes 2 elements per scanning line; the switching control signal generating unit includes two elements in one inverter; and the dynamic shift register include 6 elements for one output. Thus, a total of 10 switching transistor elements are included for one scanning line where no block division of scanning lines is included. Accordingly, if the cell shown in FIG. 2 comprises matrix electrodes wherein $m=n=1{,}000$, the scanning line driver circuit requires $(2+2+6)\times 1000 = 1000$ elements, i.e., $10\times m$ switching transistors. In contrast thereto, in the present invention, if the m bit scanning lines are divided into k blocks, the signals line driver circuit may be constituted by $5m+6m/k$ switching transistors. For example, $m=1000$ and $k=4$ in the above embodiment, so that only 6500 switching transistors in total are required. Moreover, the present invention provides a driving apparatus of a simple circuit construction adapted for a scanning driver circuit for supplying a scanning signal having at least two phases and having mutually opposite polarities in the respective phases with respect to a reference potential. As a result, the number of ICs used in the driving apparatus may be decreased, and the production cost of a display apparatus may be decreased.

What is claimed is:

1. A driving apparatus, comprising a scanning driver circuit connected to scanning electrodes and a signal driver circuit connected to signal electrodes, said scanning driver circuit comprising:

(1) a driver signal voltage generating unit which includes:

a first signal voltage generating unit comprising:

a first circuit for generating a scanning selection signal including a sequence of three voltages comprising a voltage of one polarity, a voltage of the other polarity, and zero voltage, and means for controlling said first circuit so as to generate the sequence of three voltages in different phases and for continuously supplying the scanning selection signal comprising the sequence of three voltages to a first bus, the polarities and the zero level of the voltages being defined with respect to a scanning nonselection signal voltage, and a second signal voltage generating unit for generating a scanning nonselection signal voltage continuously supplied to a second bus;

(2) a switching circuit unit for selectively supplying the scanning selection signal or the scanning nonselection signal to a scanning electrode; and (3) a switching signal generating unit for supplying a switching control signal to the switching circuit unit.

2. An apparatus according to claim 1, wherein said switching signal generating unit generates a switching control signal for sequentially supplying the scanning selection signal to the scanning electrodes.

3. An apparatus according to claim 1, wherein said switching circuit unit comprises a transistor.

4. An apparatus according to claim 3, wherein the transmitter in the switching circuit unit comprises a field effect transistor.

5. An apparatus according to claim 4, wherein said field effect transistor comprises a thin film transistor.

6. An apparatus according to claim 5, wherein said thin film transistor comprises a semiconductor film of amorphous silicon, polysilicon, CdSe or ZnSe.

7. An apparatus according to claim 1, wherein said switching signal generating circuit includes a shift register and an inverter.

8. An apparatus according to claim 7, wherein said shift register is a dynamic shift register.

9. A driving apparatus for a display panel of a type comprising matrix electrodes formed by scanning electrodes and signal electrodes arranged to intersect with the scanning electrodes, wherein a contrast at each intersection of the scanning electrodes and the signal electrodes is discriminated depending on the direction of an electric field applied to the intersection, said scanning electrodes being connected to a scanning driver circuit and said signal electrodes being connected to a signal driver circuit, said scanning driver circuit comprising:

(1) a driver signal voltage generating unit which includes:

a first signal voltage generating unit comprising:

a first circuit for generating a scanning selection signal including a sequence of three voltages comprising a voltage of one polarity, a voltage of the other polarity, and zero voltage, and means for controlling said first circuit so as to generate the sequence of three voltages in different phases and for continuously supplying the scanning selection signal comprising the sequence of three voltages to a first bus, the polarities and the zero level of the voltages being defined with respect to a scanning nonselection signal voltage, and a second signal voltage generating unit for generating a scanning nonselection signal voltage continuously supplied to a second bus;

(2) a switching circuit unit for selectively supplying the scanning selection signal or the scanning nonselection signal to a scanning electrode; and (3) a switching signal generating unit for supplying a switching control signal to the switching circuit unit.

10. An apparatus according to claim 9, wherein said switching signal generating unit generates a switching control signal for sequentially supplying the scanning selection signal to the scanning electrodes.

11. An apparatus according to claim 9, wherein said scanning nonselection signal voltage comprises a constant voltage, and wherein said scanning selection signal voltage comprises a positive-polarity voltage and a negative-polarity voltage respectively with reference to the scanning nonselection signal voltage.

12. An apparatus according to claim 9, wherein said scanning nonselection signal voltage is a constant voltage, and wherein said scanning selection signal voltage comprises a positive-polarity voltage, a negative polarity voltage and a voltage of the same level, respectively, with reference to the scanning nonselection signal voltage.

13. An apparatus according to claim 9, further comprising synchronizing means for synchronizing the scanning selection signal with a data signal supplied from said signal driver circuit to a signal electrode.

14. An apparatus according to claim 9, wherein said switching circuit unit comprises a transistor.

15. An apparatus according to claim 14, wherein the transistor in the switching circuit unit comprises a field effect transistor.

16. An apparatus according to claim 15, wherein said field effect transistor comprises a thin film transistor.

17. An apparatus according to claim 16, wherein said thin film transistor comprises a semiconductor film of amorphous silicon, polysilicon, CdSe or ZnSe.

18. An apparatus according to claim 9, wherein said switching signal generating circuit includes a shift register and an inverter.

19. An apparatus according to claim 18, wherein said shift register comprises a dynamic shift register.

20. An apparatus according to claim 9, wherein a ferroelectric liquid crystal is disposed at the intersections of the scanning electrodes and the signal electrodes.

21. An apparatus according to claim 20, wherein said ferroelectric liquid crystal comprises a chiral smectic liquid crystal.

22. An apparatus according to claim 21, wherein said chiral smectic liquid crystal is disposed in a layer thin enough to release the helical structure inherent to the chiral smectic liquid crystal in the absence of an electric field.

23. An apparatus according to claim 9, wherein said switching circuit is disposed on a substrate constituting said display panel.

24. An apparatus according to claim 9, wherein said switching circuit, switching signal generating unit, first bus, and second bus are disposed on a substrate constituting said display panel.

* * * * *

UNITED STATES PATENT AND TRADEMARK OFFICE

CERTIFICATE OF CORRECTION

PATENT NO. : 4,930,875

DATED : June 5, 1990

INVENTOR(S) : HIROSHI INOUE ET AL.

It is certified that error appears in the above-identified patent and that said Letters Patent is hereby corrected as shown below:

On the Title page

AT [56] REFERENCES CITED

U.S. Patent Documents, insert
--4,655,561 4/1987 Kanbe et al.....350/350S
4,367,924 1/1983 Clark et al.....350/350S--.

Foreign Patent Documents, insert
-- 107216 8/1981 Japan
2164776 3/1986 Great Britain
2178582 2/1987 Great Britain
2544884 10/1984 France--.

Other Publications, insert
--R. Meyer et al.—"Ferroelectric Liquid Crystals", pp. L69-L71—Journal De Physique—Vol. 36, No. 3—1975.
N. Clark et al.—"Submicrosecond Bistable Electro-Optic Switching In Liquid Crystals", pp. 899-901—Applied Physics Letters—Vol. 36, No. 11—1980.--.

COLUMN 3

Line 19, "the" should read --and--.
Line 28, "G (SmC*)-phase" should read --G (SmG*)-phase--.
Line 31, ""ferroelectric" should read --"Ferroelectric--.
Line 52, "example," should read --example--.
Line 68, "o" should read --of--.

COLUMN 5

Line 9, "of set a" should read --of a set of--.
Line 42, "to the signal applied" should be deleted.

UNITED STATES PATENT AND TRADEMARK OFFICE

CERTIFICATE OF CORRECTION

PATENT NO. : 4,930,875

DATED : June 5, 1990

INVENTOR(S) : HIROSHI INOUE ET AL.

It is certified that error appears in the above-identified patent and that said Letters Patent is hereby corrected as shown below:

COLUMN 6

Line 64, "comprises" should read --comprise--.

COLUMN 7

Line 17, "signal." should read --lines.--.

COLUMN 9

Line 49, "include" should read --includes--.
Line 58, "signals" should read --signal--.

COLUMN 10

Line 39, "transmitter" should read --transistor--.

Signed and Sealed this

Twenty-second Day of December, 1992

*Attest:*

DOUGLAS B. COMER

*Attesting Officer*

*Acting Commissioner of Patents and Trademarks*